US009828837B2

(12) United States Patent
O'Brien

(10) Patent No.: US 9,828,837 B2
(45) Date of Patent: Nov. 28, 2017

(54) FLOW CONTROL DEVICES INCLUDING A SAND SCREEN HAVING INTEGRAL STANDOFFS AND METHODS OF USING THE SAME

(71) Applicant: Robert S. O'Brien, Katy, TX (US)

(72) Inventor: Robert S. O'Brien, Katy, TX (US)

(73) Assignee: Baker Hughes, Houston, TX (US)

( * ) Notice: Subject to any disclaimer, the term of this patent is extended or adjusted under 35 U.S.C. 154(b) by 704 days.

(21) Appl. No.: 13/940,968

(22) Filed: Jul. 12, 2013

(65) Prior Publication Data

US 2015/0013966 A1 Jan. 15, 2015

(51) Int. Cl.
*E21B 43/12* (2006.01)
*E21B 43/08* (2006.01)

(52) U.S. Cl.
CPC ..... *E21B 43/12* (2013.01); *E21B 43/088* (2013.01)

(58) Field of Classification Search
CPC ..... E21B 43/08; E21B 43/088; E21B 43/12
See application file for complete search history.

(56) References Cited

U.S. PATENT DOCUMENTS

| | | | | |
|---|---|---|---|---|
| 80,875 A | | 8/1868 | Platt et al. | |
| 85,428 A | | 12/1868 | Burditt et al. | |
| 1,339,898 A | | 5/1920 | Layne | |
| 1,342,813 A | | 6/1920 | Huston | |
| 1,635,368 A | | 7/1927 | Layne | |
| 2,046,459 A | | 7/1936 | Johnson | |
| 2,185,999 A | | 1/1940 | Johnson | |
| 3,025,914 A | | 3/1962 | Fether | |
| 3,133,595 A | | 5/1964 | Loughney et al. | |
| 3,504,936 A | | 4/1970 | Brown et al. | |
| 3,726,546 A | | 4/1973 | Brown | |
| 4,096,911 A | | 6/1978 | Geske | |
| 4,125,129 A | | 11/1978 | Baumann | |
| 4,176,717 A | | 12/1979 | Hix | |
| 4,267,045 A | * | 5/1981 | Hoof | B01D 25/26 137/625.37 |
| 4,281,858 A | | 8/1981 | Bower | |
| 4,423,889 A | | 1/1984 | Weise | |

(Continued)

FOREIGN PATENT DOCUMENTS

| | | |
|---|---|---|
| EP | 1001132 A2 | 5/2000 |
| WO | 0026501 A1 | 5/2000 |

(Continued)

OTHER PUBLICATIONS

PCT International Search Report and Written Opinion; International Application No. PCT/US2015/017515; International Filing Date: Feb. 25, 2015; dated Jun. 8, 2015; 16 Pages.

(Continued)

*Primary Examiner* — Shane Bomar
*Assistant Examiner* — Christopher Sebesta
(74) *Attorney, Agent, or Firm* — Cantor Colburn LLP

(57) ABSTRACT

In one aspect, a flow control device is disclosed that in one embodiment may include a sand screen that includes adjacent wraps of a longitudinal member, wherein the longitudinal member has a width, a first axial side and a second axial side, the longitudinal member further including spaced apart standoffs along the first axial side and spaced apart channels that provide fluid paths from the second axial side to the first axial side.

2 Claims, 5 Drawing Sheets

(56) References Cited

U.S. PATENT DOCUMENTS

| | | | | |
|---|---|---|---|---|
| 4,778,008 | A | 10/1988 | Gonzalez et al. | |
| 5,122,271 | A * | 6/1992 | Simon | B01D 29/15 210/314 |
| 5,341,880 | A | 8/1994 | Thorstensen | |
| 5,769,122 | A * | 6/1998 | Baumann | F16K 47/08 137/625.3 |
| 5,823,264 | A | 10/1998 | Ringgenberg | |
| 6,003,607 | A | 12/1999 | Hagen et al. | |
| 6,125,932 | A | 10/2000 | Hamid et al. | |
| 6,367,552 | B1 | 4/2002 | Scott et al. | |
| 6,447,021 | B1 | 9/2002 | Haynes | |
| 6,978,840 | B2 | 12/2005 | Henderson | |
| 7,055,598 | B2 | 6/2006 | Ross et al. | |
| 7,086,479 | B2 | 8/2006 | Schultz et al. | |
| 7,284,606 | B2 | 10/2007 | Coronado | |
| 7,578,343 | B2 | 8/2009 | Augustine | |
| 7,673,678 | B2 | 3/2010 | MacDougall et al. | |
| 7,891,420 | B2 | 2/2011 | Dale et al. | |
| 8,061,430 | B2 | 11/2011 | Du et al. | |
| 8,201,623 | B2 | 6/2012 | O'Brien | |
| 8,220,555 | B1 | 7/2012 | Wintill et al. | |
| 8,286,701 | B2 | 10/2012 | Schultz et al. | |
| 8,403,061 | B2 | 3/2013 | Russell et al. | |
| 8,424,609 | B2 | 4/2013 | Duphorne et al. | |
| 2002/0092653 | A1 | 7/2002 | Scott et al. | |
| 2003/0029621 | A1 | 2/2003 | Haynes | |
| 2003/0141059 | A1 | 7/2003 | Mauldin et al. | |
| 2003/0188894 | A1 | 10/2003 | Sunde et al. | |
| 2005/0039916 | A1 | 2/2005 | Schultz et al. | |
| 2006/0027377 | A1 | 2/2006 | Schoonderbeek et al. | |
| 2006/0260818 | A1 | 11/2006 | Meijer et al. | |
| 2007/0131434 | A1 | 6/2007 | MacDougall et al. | |
| 2009/0133874 | A1 | 5/2009 | Dale et al. | |
| 2010/0163250 | A1 | 7/2010 | Schultz et al. | |
| 2010/0224375 | A1 | 9/2010 | Du et al. | |
| 2010/0252250 | A1* | 10/2010 | Fripp | E21B 34/08 166/66 |
| 2011/0048706 | A1 | 3/2011 | Clem et al. | |
| 2011/0079396 | A1 | 4/2011 | Russell et al. | |
| 2011/0127047 | A1 | 6/2011 | Themig et al. | |
| 2011/0146988 | A1 | 6/2011 | McGlothen | |
| 2011/0186286 | A1 | 8/2011 | Allen | |
| 2011/0209873 | A1 | 9/2011 | Stout | |
| 2011/0226481 | A1 | 9/2011 | Duphorne et al. | |
| 2011/0278017 | A1 | 11/2011 | Themig et al. | |
| 2012/0085548 | A1 | 4/2012 | Fleckenstein et al. | |
| 2013/0108356 | A1 | 5/2013 | Stautzenberger et al. | |
| 2013/0199799 | A1 | 8/2013 | Phan et al. | |
| 2014/0166312 | A1 | 6/2014 | Richards et al. | |
| 2015/0013966 | A1 | 1/2015 | O'Brien | |
| 2015/0013980 | A1 | 1/2015 | Duphorne et al. | |
| 2015/0252628 | A1 | 9/2015 | Cochran et al. | |
| 2015/0375144 | A1 | 12/2015 | Greci | |
| 2016/0069145 | A1 | 3/2016 | McGuire et al. | |
| 2016/0084018 | A1 | 3/2016 | Allen | |
| 2016/0123093 | A1 | 5/2016 | Richards et al. | |

FOREIGN PATENT DOCUMENTS

| | | | |
|---|---|---|---|
| WO | WO2007078375 | A2 | 7/2007 |
| WO | 2012162792 | | 12/2012 |
| WO | WO2012162792 | A1 | 12/2012 |

OTHER PUBLICATIONS

PCT International Search Report and Written Opinion, International Application No. PCT/US2014/042081; International Filing Date: Jun. 12, 2014; dated Oct. 6, 2014; pp. 1-14.

PCT International Search Report and Written Opinion; International Application No. PCT/US2014/055889; International Filing Date: Sep. 16, 2014; dated Dec. 23, 2014; pp. 1-10.

PCT International Search Report and Written Opinion; International Application No. PCT/US2014/055886; International Filing Date: Sep. 16, 2014; dated Dec. 19, 2014; pp. 1-9.

PCT International Search Report and Written Opinion; International Application No. PCT/US2014/055887; International Filing Date: Sep. 16, 2014; dated Dec. 18, 2014; pp. 1-10.

PCT International Search Report and Written Opinion; International Application No. PCT/US2015/014607; International Filing Date: Feb. 5, 2015; dated May 19, 2015; pp. 1-10.

* cited by examiner

FLOW CONTROL DEVICES INCLUDING A SAND SCREEN HAVING INTEGRAL STANDOFFS AND METHODS OF USING THE SAME

BACKGROUND

1. Field of the Disclosure

The disclosure relates generally to apparatus and methods for control of fluid flow from subterranean formations into a production string in a wellbore.

2. Description of the Related Art

Hydrocarbons such as oil and gas are recovered from subterranean formations using a well or wellbore drilled into such formations. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole, and in a particular case may be used for injection of steam or other substances into a geological formation. One or more flow control devices are placed in the wellbore to control the flow of fluids from the formation into the wellbore. These flow control devices and production zones are generally fluidly isolated or separated from each other by installing a packer between them. Fluid from each production zone entering the wellbore is drawn into a tubular that runs to the surface. The fluid from a formation ("formation fluid") often includes solid particles, generally referred to as the "sand". Flow control devices generally include a sand screen that inhibits flow of solids above a certain size. Also, it is desirable to have a substantially even flow of fluid along the production zone. Uneven fluid flow may result in undesirable conditions such as invasion of a gas cone or water cone. Water or gas flow into the wellbore can significantly reduce the amount and quality of the production of oil.

Horizontal wellbores are often drilled into a production zone to extract fluid therefrom. Several flow control devices are placed spaced apart along such a wellbore to drain formation fluid. Formation fluid often contains a layer of oil, a layer of water below the oil and a layer of gas above the oil. A horizontal wellbore is typically placed above the water layer. The boundary layers of oil, water and gas may not be even along the entire length of the horizontal wellbore. Also, certain properties of the formation, such as porosity and permeability, may not be the same along the horizontal wellbore length. Therefore, fluid between the formation and the wellbore may not flow evenly through the inflow control devices. For production wellbores, it is desirable to have a relatively even flow of the production fluid into the wellbore. To produce optimal flow of hydrocarbons from a wellbore, production zones may utilize flow control devices with differing flow characteristics.

Flow control devices generally include a sand screen and an inflow control device. The sand screen is used to inhibit flow of solid, such as rock pieces into the production tubing. The inflow control device controls the flow of the formation fluid into production tubing and to produce optimal fluid from each production zone. Sand screens generally are formed by placing stand offs axially on a tubular and then wrapping a wire around the standoffs. The spacing between the adjacent wire wraps defines grain size that is inhibited from flowing through the sand screen. The inflow control devices may be active devices, such as sliding sleeve valves, or passive devices. The active inflow control devices are relatively expensive and include moving parts, which require maintenance and may not be very reliable over the life of the wellbore. Passive flow control devices do not have moving parts. Such devices are used to control the flow of the fluids into the wellbore. Both the active and passive inflow control devices are produced as separate units and then placed inside the sand screen during assembly of the flow control device. Such devices are expensive and can require substantial radial space, which can reduce the internal diameter available for the production tubing for the flow of the hydrocarbons to the surface.

The present disclosure provides flow control device that utilize a sand screen that includes integrated standoffs for providing axial flow paths an methods of using the same.

SUMMARY

In one aspect, a flow control device is disclosed that in one embodiment includes a sand made by wrapping a wire having axial spaced apart standoffs to provide axial flow of a fluid along a surface of the sand screen. In another aspect, the longitudinal member has radial channels to provide radial flow of the fluid through the sand screen and to inhibit flow of solid particles of selected sizes through the sand screen. In another aspect, the flow control device may include a sand screen that has adjacent wraps of a longitudinal member, wherein the longitudinal member has a width, a first axial side and a second axial side, the longitudinal member further including spaced apart standoffs along the first axial side and spaced apart channels that provide fluid paths from the second axial side to the first axial side.

In another aspect, a method of making a flow control device, is disclosed that in one embodiment may include: providing a longitudinal member having a width, a first axial side and a second axial side, the longitudinal member further including spaced apart standoffs along the first axial side and spaced apart channels that provide fluid paths from the second axial side to the first axial side; wrapping the longitudinal member around a tubular member; and connecting adjacent wraps of the longitudinal member to form a sand screen, wherein the standoffs provide a first fluid flow path and the channels provide a second fluid flow path.

Examples of some features of the disclosure have been summarized rather broadly in order that detailed description thereof that follows may be better understood, and in order that some of the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters generally designate like or similar elements throughout the several figures, and wherein.

DETAILED DESCRIPTION OF THE DISCLOSURE

Figure 1:
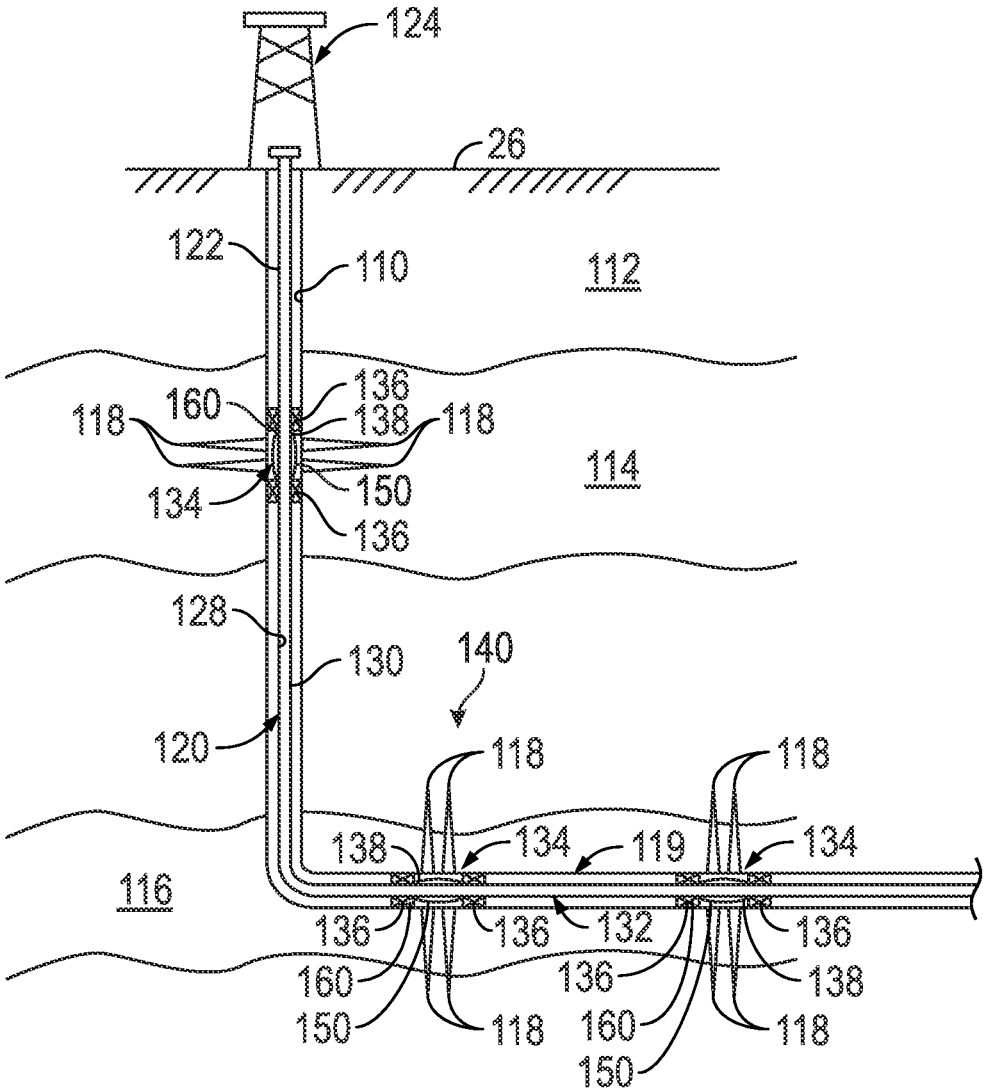
FIG. 1 is a schematic elevation view of an exemplary multi-zonal wellbore and production assembly which incorporates a sand screen according to one embodiment of the disclosure.

The present disclosure relates to devices and methods for controlling production of hydrocarbons in wellbores. The present disclosure is susceptible to embodiments of different forms. There are shown in the drawings, and herein will be described, specific embodiments of the present disclosure with the understanding that the present disclosure is to be considered an exemplification of the principles of the devices and methods described herein and is not intended to limit the disclosure to the specific embodiments. Also, the feature or a combination of features should not be construed as essential unless expressly stated as essential.

FIG. 1 shows an exemplary wellbore 110 that has been drilled through the earth formation 112 and into a pair of production formations 114, 116 from which it is desired to produce hydrocarbons. The wellbore 110 is cased by metal casing, as is known in the art, and a number of perforations 118 penetrate and extend into the formations 114, 116 so that production fluids 140 may flow from the formations 114, 116 into the wellbore 110. The wellbore 110 has a deviated or substantially horizontal leg 119. The wellbore 110 has a production string or assembly, generally indicated at 120, disposed therein by a tubing string 122 that extends downwardly from a wellhead 124 at the surface 126. The production assembly 120 defines an internal axial flow bore 128 along its length. An annulus 130 is defined between the production assembly 120 and the wellbore casing. The production assembly 120 has a deviated, generally horizontal portion 132 that extends along the deviated leg 119 of the wellbore 110. Production nipples 134 are positioned at selected points along the production assembly 120. Optionally, each production nipple 134 is isolated within the wellbore 110 by a pair of packer devices 136. Although only three production nipples 134 are shown in FIG. 1, there may, in fact, be a large number of such nipples arranged in serial fashion along the horizontal portion 132.

Each production nipple 134 may include a flow control or production flow control device 138 to govern one or more aspects of a flow of one or more fluids into the production assembly 120. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 138 may include a number of alternative constructions of sand screen 150 and an inflow control device 160 that inhibits the flow of solids from the formations 114 and 116 into the string 120.

Figure 2:
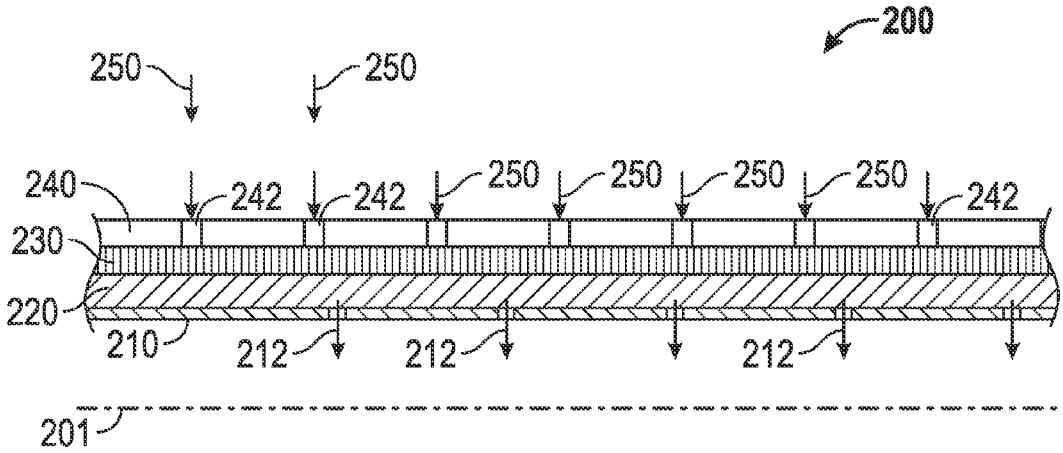
FIG. 2 shows a sectional side view of a portion of a flow control device made according to one embodiment the disclosure.

FIG. 2 shows a longitudinal sectional side-view of a flow control device 200 made according to one embodiment the disclosure. The flow control device includes a base pipe or tubular 210 having an axis 201 and a number of radially and axially placed fluid passages 212. The tubular 210 is surrounded by an inflow flow control device 220 that controls the flow of a fluid 250 into the passages 212. A sand screen 230, made according to one embodiment of the disclosure, is shown placed around the inflow control device 220 to inhibit flow of solid particles above a certain size through the sand screen 230. A shroud 240 having flow passages 242 may be placed around the sand screen 230 to protect the sand screen 230 and allow sufficient flow of the fluid 250 to the sand screen 230. In aspects, the sand screen 230 includes integrated stand offs at its inner side to allow axial flow of the fluid along and into the inflow control device 220, as described in more detail in reference to FIGS. 3-6.

Figure 3:
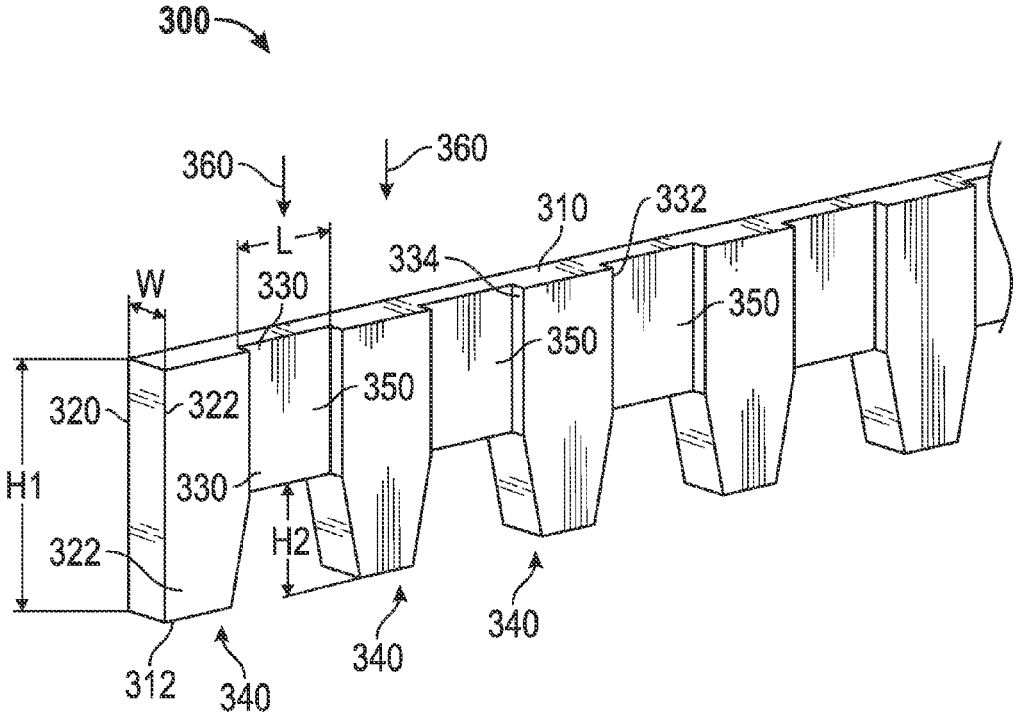
FIG. 3 shows an isometric view of a longitudinal member according to one embodiment of the disclosure that may be formed into a sand screen.

FIG. 3 shows an isometric view of a longitudinal member 300 for forming a sand screen, according to one embodiment of the disclosure. In one aspect, the longitudinal member 300 may be a continuous member, made from a material suitable for downhole use, including, but not limited to steel, steel alloy, and another metallic alloy, which can be wrapped about along a tubular or mandrel to form a sand screen. The longitudinal member 300 also is referred to herein as a "wire". In one configuration, the member 300 has a depth or height "H1" with a first axial side (also referred to as the upper or top or outer side) 310, a second axial side (also referred to as inner or lower or bottom side) 312. The member 300 has width "W" that has a first side 320 and a second side 322. The particular configuration of member 300 includes serially spaced standoffs 340 of height H2 along the bottom side 312 of the member 300. Between the stand offs 340, channels 350 of width "L" and depth "D" are provided from the top side 310 extending toward the bottom side 312 to allow fluid 360 to flow radially (from outer side to the inner side) through the channels 350. The depth D defines the grain size of the solids inhibited from flowing through the channels 350, while the depth of a channel and the length L defines the fluid volume that can flow through the channels 350. The member 300 may be formed by any suitable manners, including, but not limited to, extruding a material to form a continuous of height H1. The standoffs 340 and channels 350 may be formed during the extruding process, by a stamping process or cutting material from the lower side 312 to form the standoffs 340 and stamping the continuous member to form the channels 350. Any other suitable method may be also be utilized to form the member 300, such as stamping, casting or 3-D printing, etc. In aspects, the finished member 300 is a continuous member that has integral standoffs 340 along an inner axial or longitudinal side of the member 300. In another aspect, the member 300 includes integral axial standoffs 340 and spaced apart channels 350 that allow flow of a fluid from the top side 310 toward the bottom side 312 and inhibit the flow of solids therethrough. In an alternative embodiment, the longitudinal member 300 may be a continuous member that includes flow paths or indentations, such as flow paths 350 without integral standoffs. In such a case the standoffs may be separate members placed along a length (axially) of a tubular or mandrel and the member wrapped over such standoffs to form the sand screen.

Figure 4:
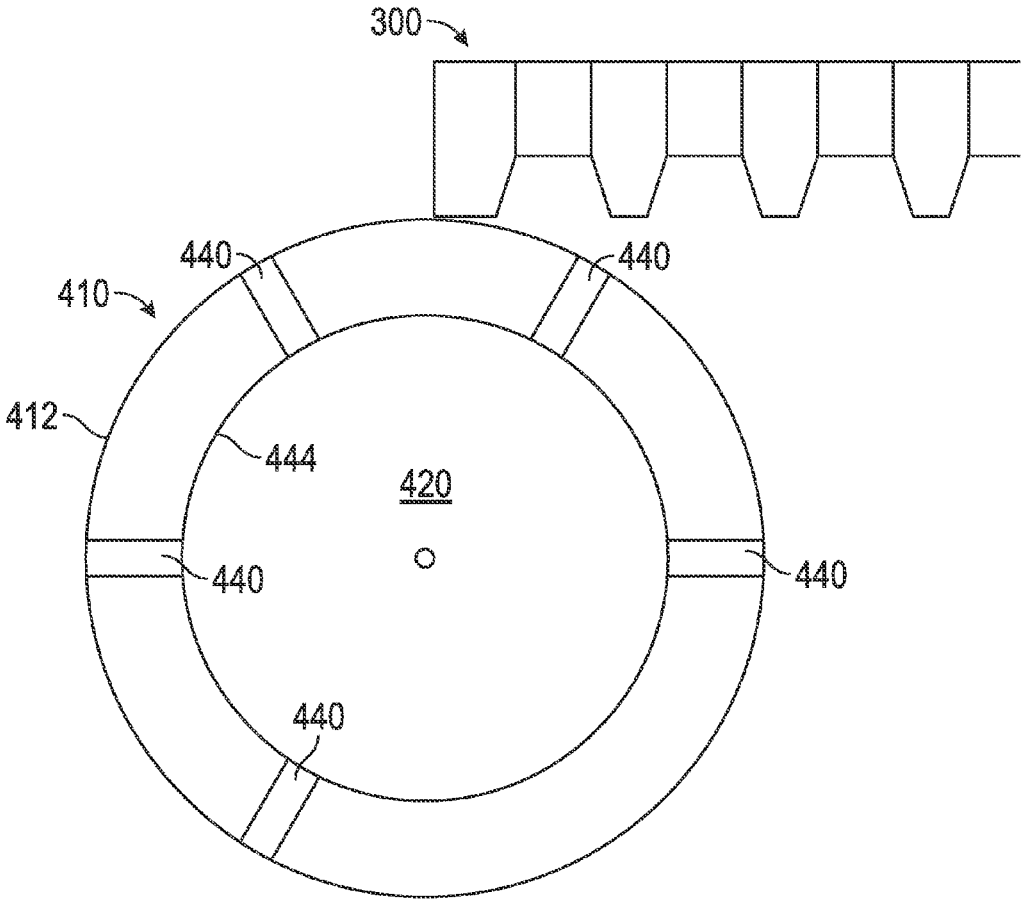
FIG. 4 shows a method of wrapping the longitudinal member of FIG. 3 onto a tubular to form a sand screen, according to one embodiment of the disclosure.

FIG. 4 shows a method of wrapping a longitudinal member, such as member 300 of FIG. 3 onto a tubular or mandrel 410 to form a sand screen, according to one embodiment of the disclosure. In one aspect, the tubular 410 may be a hollow member having central axis 420, an outer surface 412 and an inner surface 414. In another configuration, the member 410 may be a solid tubular member. To form a sand screen, the member 300 may be wrapped around the tubular 410 and adjacent wrap members may be bonded or connected by any suitable method known in the art, including, but not limited to, welding and brazing. The tubular or the mandrel 410 may then be removed to provide a unitary sand screen having standoffs along an inner side to provide a first flow path and channels to provide a second flow path. Such a sand screen may then be utilized in any suitable flow control device, such as device 138 shown and described in reference to FIG. 2. In another aspect, the tubular 410 may include fluid passages 440 and may not be removed from the wrapped member 300. In such a case, the finished device will be a fluid flow device that includes a base tubular having fluid passages and a sand screen on the tubular that has integral standoffs.

Figure 5:
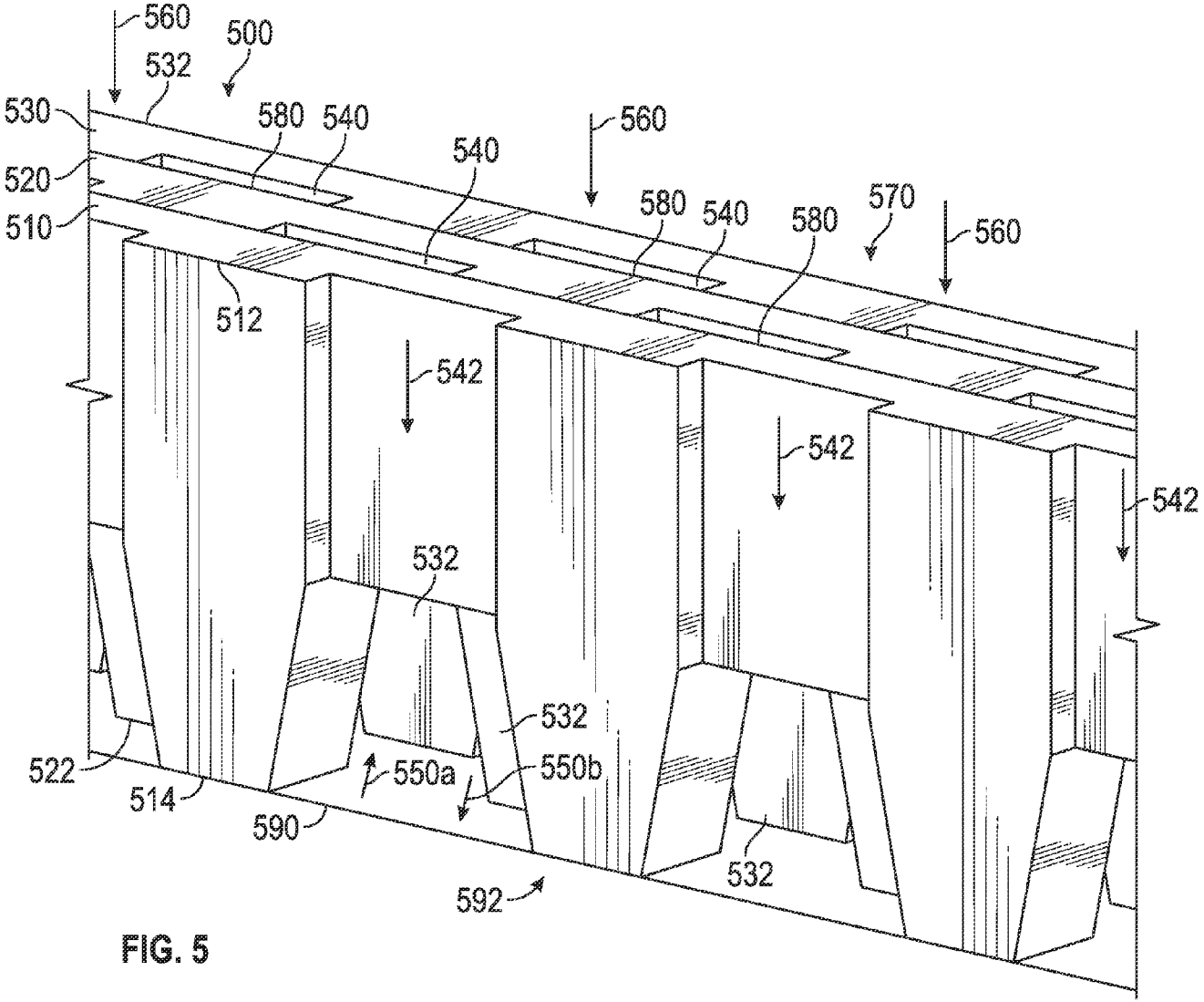
FIG. 5 shows an isometric view of a unfolded three wraps of the longitudinal member of FIG. 3.

FIG. 5 shows a partial isometric view of sand screen 500 formed using the longitudinal member 300 of FIG. 3 after the member 300 has been formed into a sand screen as described in reference to FIG. 4. FIG. 5 shows a first wrap 510, a second wrap 520 adjacent the first wrap 510 and a third wrap 540 adjacent the second wrap 520. In the sand screen section shown in FIG. 5, the adjacent wraps are connected to each other. For example, wrap 510 is connected to wrap 520 and wrap 530 is connected to wrap 520 and so on. In such a sand screen, flow channels 540 are formed between adjacent wraps as shown in FIG. 5. When sand screen 500 is installed in a device in a wellbore section, such as device 138 (FIG. 1) along the horizontal section in formation (116, FIG. 1), a fluid 560 would flow from the formation into the channels 540 and discharge above a tubular 590 over which the sand screen 500 is disposed. In the configuration shown in FIG. 5, the fluid 560 will flow axially along directions 550*a* and 550*b*. Thus, the fluid 560 will flow radially, that is from an outer surface 570 to an inner surface 572 of the sand screen, and then axially over the tubular. The gap or the width 580 of a channel, such as channels 542, defines the size of the solids inhibited from passing through the gaps 580 and thus through the sand screen 500. The dimensions and spacing of the channels 540 may be adjusted based upon the desired application. The spacing of the channels defines the amount of the fluid flow through the sand screen.

Figure 6:
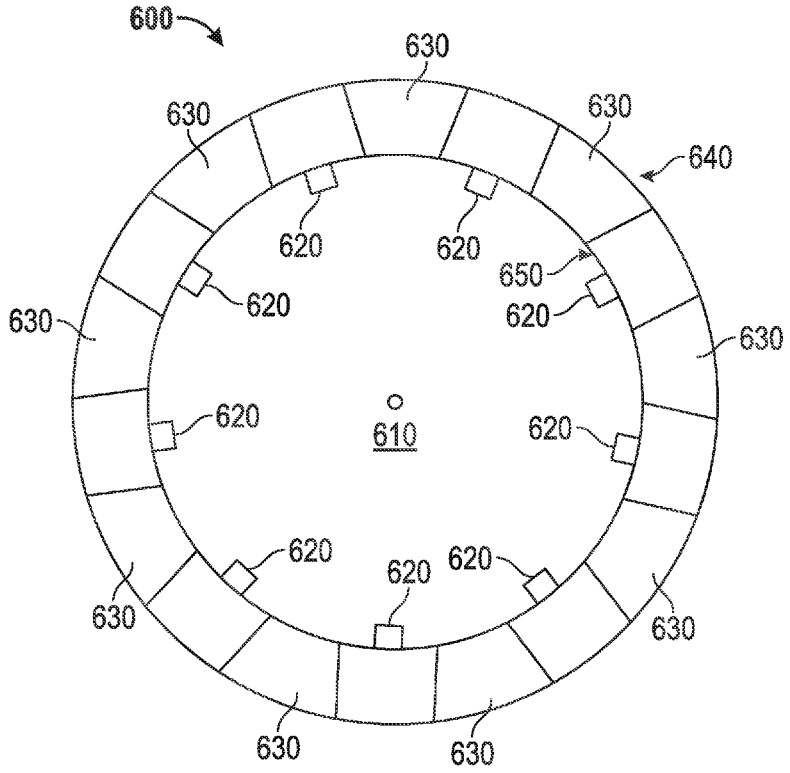
FIG. 6 shows a disc for forming a sand screen, according to one embodiment of the disclosure.

FIG. 6 shows a disc 600 having a bore 610 therethrough. The disc 600 includes standoffs 620 around the inner periphery 612 of the disc 600 and channels 630 extending from an outer surface or periphery 640 toward the inner surface or periphery 612. To form a sand screen, the discs 600 may be stacked against each other and connected to each other. In one aspect, the discs may be placed around and against each other on tubular or mandrel, such as tubular 410 shown in FIG. 4. Adjacent discs 600 may be connected to each other as they are placed against each other by any suitable mechanism. Once discs have been placed and connected to each other for a desired length, the tubular may be removed to form the sand screen that will have a unified structure substantially similar to the structure shown in FIG. 5.

It should be understood that FIGS. 1-6 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent to one skilled in the art that many modifications and changes to the embodiment set forth above are possible without departing from the scope of the disclosure.

The invention claimed is:

1. A flow control device comprising:

a plurality of discs placed adjacent to each other to form a unified longitudinal body, wherein each disc has a first side and a second side defining a width of the disc, an outer side, and a bore therethrough forming an inner side, and wherein at least some of the discs include channels extending from the outer side to the inner side of the disc, the channel having a channel depth that is less than the width of the disc extending from the second side of the disc to inhibit flow of solid particles above a certain size through the channels, the discs further including a standoff having the width of the disc and extending inward from the inner side of the disc to provide a flow path along an axis of the unified longitudinal body, the standoff being disposed between adjacent channels.

2. The flow control device of claim 1 further comprising an inflow control device placed inside the unified longitudinal body and a tubular member inside the inflow control device.

* * * * *